US006837291B2

(12) United States Patent
Leonardi

(10) Patent No.: US 6,837,291 B2
(45) Date of Patent: Jan. 4, 2005

(54) DEVICE FOR PLACING A LABEL OF ANY EXTERNAL PROFILE ON A COMPACT DISC AS WELL AS A METHOD FOR MANUFACTURING AND FOR THE USE OF THE DEVICE

(75) Inventor: Paulo Leonardi, Camerano (IT)

(73) Assignee: Fellowes, Inc., Itasca, IL (US)

( * ) Notice: Subject to any disclaimer, the term of this patent is extended or adjusted under 35 U.S.C. 154(b) by 0 days.

(21) Appl. No.: 10/789,760

(22) Filed: Feb. 27, 2004

(65) Prior Publication Data

US 2004/0168772 A1 Sep. 2, 2004

Related U.S. Application Data

(63) Continuation of application No. 09/932,130, filed on Aug. 16, 2001, now abandoned, and a continuation of application No. PCT/EP01/00547, filed on Jan. 18, 2001.

(60) Provisional application No. 60/248,155, filed on Nov. 13, 2000.

(51) Int. Cl.[7] ..... B65C 1/00; B65C 1/02

(52) U.S. Cl. ..... 156/391; 156/556; 156/580; 156/DIG. 1; 156/DIG. 2

(58) Field of Search ..... 156/391, 556, 156/580, DIG. 1, DIG. 2, DIG. 24

(56) References Cited

U.S. PATENT DOCUMENTS 6,273,167 B1 * 8/2001 Miller ..... 156/391
6,318,436 B1 * 11/2001 Hummell et al. ..... 156/556
6,321,811 B1 * 11/2001 Atkinson et al. ..... 156/391
6,347,654 B1 * 2/2002 Koch ..... 156/391
2002/0174957 A1 * 11/2002 Koch ..... 156/536

* cited by examiner

*Primary Examiner*—Sue A. Purvis
(74) *Attorney, Agent, or Firm*—Brinks Hofer Gilson & Lione

(57) ABSTRACT

The invention relates to a device for placing a label of any external profile with a first central opening onto a compact disc with a second central opening, and a method for the use of the device as well as a method for manufacturing of the device. The device has a positioning member 5, having at least one centering member 7. The outer dimension of the centering member 7 corresponds to the first central opening of the label. Moreover, the positioning member has a centering part 8 in its center, the outer diameter of which is adapted to the second central opening of the compact disc. The centering part 8 projects beyond the centering member 7. The base member has an outer ring supporting a disc-shaped top surface onto which the label can be arranged. The top surface, in turn, has a central opening within which the positioning member is provided movably perpendicular to the top surface, and, in an inoperative position, projects beyond the top surface, and, in a labeling position, is lowered into the central opening. For restoring into the inoperative position, the outer ring 10 has at least one flexible tongue 15 or 16 in a first fitted groove of the outer ring. The tongue roots 19 of the flexible tongue are fixed at the base section 20 of the outer ring, while the tongue tip 21 supports a flexible supporting beam 22 or 23. The supporting beam extends radially inwards from the tongue tips 21 to a second fitted groove 24 or 25 of the top surface up to the positioning member 5. The base member 9 has at least one mounting position 41, 42, 43 for a profile part at its top surface 11, which is fitted to the outer profile of the label and/or the compact disc, and has at least one fitted part, which is insertable into the mounting position.

22 Claims, 9 Drawing Sheets

DEVICE FOR PLACING A LABEL OF ANY EXTERNAL PROFILE ON A COMPACT DISC AS WELL AS A METHOD FOR MANUFACTURING AND FOR THE USE OF THE DEVICE

This application is a continuation of U.S. Ser. No. 09/932,130, filed Aug. 16, 2001, now abandoned which claims the benefit of U.S. Provisional Application No. 60/248,155 filed Nov. 13, 2000, and also is a con of PCT Application Ser. No. PCT/EP01/00547 filed Jan. 18, 2001, all of which in their entirety are incorporated by reference.

The invention relates to a device and a method for placing a label of any external profile on a compact disc according to the pre-characterizing portion of claim 1 and a method for manufacturing the device as well as a method for the use of the device.

From document DE 295 21 938 U1, a device for placing self-adhesive labels on compact discs is known. This device comprises several single components being coaxially nestable into each other, and thereby positioning, in a central and aligned manner on top of each other, a label on a compact disc centrally.

This device has the disadvantage that components have to be produced which are to be worked differently, which have to be nested into each other fittingly. Moreover, the device has the disadvantage that it neither has a stable inoperative position nor does it have a stable labeling position, but rather both positions are to be met by the user himself manually, without corresponding stoppers or other devices being provided for the user for aligning and assembling the label with the compact disc.

Therefore, with the increasing distribution of compact discs, which are also known as laser discs and are distributed in the form of music and compact discs-ROM-products, the necessity exists to facilitate the handling of labeling devices, and to ensure a reliable central applying of labels of any given external profile onto compact discs, in particular since within the recent years, the popularity of recordable compact discs, e.g. of Sony, 3M, and Kodak has increased, Further, compact discs are used for data storage aid for storage of programs. With this variety of applications, the necessity has increased to identify and to label compact discs as soon as they are produced. Labels are necessary on compact discs, because there is no visual method to determine the contents of manufactured compact discs which can contain more than 680 MB of data. While manufacturers of large amounts of identical compact discs with prefabricated and already applied blank discs or directly on the rear side of the discs can draw, paint or apply in another manner a layer of ink and pigments with their own identification information, this process cannot be carried out by manufacturers of recordable compact discs because the user himself determines what is to be stored on compact discs. With low number of copies and copies where an immediate availability of the compact discs is required, the printing and drawing of labels requires too much time, and requires too high costs of investment for the specific equipment.

A further embodiment of a labeling device is known from document WO 98/26986. This device comprises a base member being surrounded by an outer ring, and having a fixed centering rod in its center, whereby the diameter of the centering rod corresponds to the central opening of a compact disc. On his base member, a disc is fixed with radially inwardly extending blade springs. The blade springs are clamped on one side at the edge of the disc, and support at their free end vertically aligned centering members for centering a label and for carrying a compact disc to be placed on the centering rod. Thereby, the compact disc is held by the flexibly supported centering members in a distance from the label, and for labeling, the compact disc can be pushed onto the label. Thereby, the risk exists that the label can be displaced, because the centering members can be displaced relative to each other during the lowering of the compact discs, and thereby, the centering diameter can be reduced.

The disadvantage of reducing of the centering diameter can be compensated by precisely dimensioned projections at the tips of the centering members, however, these projections can only become effective when the compact discs are set completely plane-parallel to the label by the user. This, however, has a tremendous additional disadvantage, because during the handling of this labeling devices, it cannot be presupposed that the user carries out a plane-parallel guidance of the compact discs with respect to the label being arranged in a distance. Already due to slight tilting of the compact disc, the label will be fixed or glued at an outer point which does not correspond to the center of the compact disc, and the damage of the inner edge of the label will result from the projections fixed to the centering members on the opposing inner edge of the conglutination between compact disc and label resulting from tilting.

In case, the centering projections are omitted to avoid damage of the labels through the projections during tilting of the compact disc, the risk exists that the label will be glued totally eccentrical on the compact disc, because during lowering of the compact disc, the centering diameter of the centering members will be reduced, and therefore, the position of the label will not be ensured. Due to application of an eccentrical label on a compact disc, a balance error will occur in the reproducing system such that it can stress or even damage the drive assembly of the reproducing system.

The object of the invention is to provide a device for placing a label of any external profile with a central opening onto a compact disc which overcomes the disadvantages of prior art, and secures an improved guidance of the label with respect to the compact disc during the preparation and carrying out the labeling procedure. Further, it is the object of the invention to provide a labeling device which can be manufactured at low costs, and provides for a simplified and cost-effective assembly.

This object is solved by the subject-matter of the independent claims. Preferred embodiments of the invention are defined in the dependent claims.

Preferably, the device for placing a label of any external profile with a central opening onto a compact disc with a smaller central opening, has the following components:

1. a positioning member, having at least one centering member, the external dimension of which is adapted to the central opening of the label, and which has a centering part in its center—preferably a centering rod—the external diameter of which is adapted to the central opening of a compact disc, and which projects beyond the centering member,
2. a base member with an outer ring supporting a disc-shaped top surface on which the label can be positioned, whereby the top surface has a central opening within which the positioning member is arranged movably perpendicular with respect to the top surface, and projects, in its inoperative position, beyond the top surface, and is lowered into the central opening in its labeling position,
3. at least one flexible tongue which is placed within a first adapted groove of the outer ring whereby the tongue root of the flexible tongue is fixed at a base section of the outer ring, and the tongue tip supports a flexible supporting beam, 4. whereby the supporting beam extends radially inwardly from the tongue tip into a second adapted groove of the disc-shaped top surface to the positioning member,
5. at least one mounting position on the top surface of the base member for at least one profile part which is adapted to the external profile of the label and/or of the compact disc.

This device has the advantage that the positioning member which is capable of supporting a compact disc on its centering members, forms a compact unit with the at least one centering member and the centering rod such that during the transition from the inoperative position of the positioning part to the labeling position of the positioning part, neither the label resting on the disc-shaped top surface of the outer ring, nor the compact disc being held by the centering rod moving together with the positioning member and the centering members in central alignment with respect to the label, can be displaced relative to each other even if the user should tilt the compact disc slightly while placing the compact disc.

By means of the stable and rigid assembly of the positioning member, and the centering member fixed firmly thereto as well as the centering rod being fixed firmly thereto, neither the centering diameter of the label nor the centering diameter of the compact disc do change during transition from an inoperative position into the labeling position. Further, the compact disc is held in a completely stable position because no relative movements between the centering rod and the central opening of the compact disc are required during the labeling process so that the risk of tilting the compact disc does not arise.

Moreover, a profile part adapted to any external profile of the label and/or the compact disc can be placed on the top surface of the base member in the mounting position such that labels and/or compact discs having a polygonal external profile can be aligned on top of each other. Also any other profiles as star-shapes, postcard shapes and so on can be worked with the device according to the present invention.

In a preferred embodiment of the invention, a profile part is provided as a beam with at least one journal having a polygonal cross-section, and fits into at least one mounting position having a corresponding polygonal cross-section. The polygonal cross-section ensures the precise alignment of the beam on the top surface of the base member. The beam itself forms a projecting wall rising perpendicular to the top surface which is aligned or arranged congruent to a straight-line external profile of the label and/or compact disc.

A further embodiment of the invention provides for the profile member to have at least one beam with at least two journals whereby the journals are insertable into two fitted mounting positions on the top surface of the base member. In this embodiment, a precise alignment of the beams along a straight-lined external profile of the label and/or the compact disc is achieved by the arrangement of two mounting positions, and the alignment of the beam by means of inserting of the two journals into the mounting position. For this, the journals can be formed as pins with round cross-sections.

According to a further preferred embodiment of the invention, the profile part is arranged on a compensation disc, whereby the compensation disc has a central opening corresponding to the central opening of the label. This compensation disc covers, on the one hand, the groove on the top surface on the base member, which is provided for the supporting beams. Thereby, a plane base is provided for the label such that the label is supported during labeling also in the regions of the grooves on the top surface of the base member. Further, the compensation disc can be provided integrally with the profile part. A stock of compensation discs with differently shaped and arranged profile parts can therefore be adapted to any external profile of the components to be brought on top of each other (label and/or compact disc).

In a preferred embodiment of the invention, the cross-section of the flexible tongues is concave-curved, and each flexible tongue has a pressure point. This is achieved in an advantageous manner if the flexible tongues are parts of the outer ring, and are formed by cutting the outer ring. Thus, a concave cross-section of the flexible tongues results, the curvature of which corresponds to the curvature of the outer ring. During lowering of the positioning member from the inoperative position into the labeling position, the supporting belt has to overcome a pressure point by load transmission to overcome the form resistance of the concave cross-section of the flexible tongues, and to pass over into the labeling position. At the same time, this has the advantage that a substantially reinforced restoring force for the snapping back into the inoperative position is effected by the flexible tongues. This pressure point additionally facilitates the handling of the device because the positioning member takes an extremely stable position during placement of the label and during placement of the compact disc, which only releases a positioning member due to overcoming of the pressure point of the concave-curved spring, to carry out the labeling process.

In a further embodiment of the invention the positioning member is formed as a one-piece unit with the centering member and centering rod, which are dimensionally stable and resilient without being deformed during the transition from the inoperative position into the labeling position.

In a further preferred embodiment of the invention, the centering member and the centering rod are movable together and at the same time perpendicular to the disc-shaped top surface. Such a function cannot be carried out according to the subject-matter known from WO 98/26986, because the centering rod is mounted stationary on the base member in the known embodiment and, therefore, the compact disc has to be guided with its central opening at the centering rod implicating the risk of tilting, which is improved by the present invention because according to the present invention, there are no relative movements between compact disc/centering rod nor do they have to be carried out by the user.

A further embodiment of the invention provides for the centering member, the centering rod, the flexible supporting beams, the flexible tongues, and the outer ring to be connected to each other none-releasably. This is achieved by the one-piece form of the device. Consequently, in contrast to prior art, several complex parts do not have to be assembled or fitted together for forming of the device but rather all functional parts of the present invention together form a one-piece component which, preferably is provided as a one-piece injection-molded part.

To realize a one-piece injection-molded part which can be fabricated in a two-part injection mould in a most simple manner, the walls can be slightly tapered to ensure a detachment of the injection mould. These tapered walls also improve the functionality of the labeling device because the centering rod is not completely formed cylindrical but rather is tapered towards its tip, facilitating a placement of the compact disc. The same applies for the centering members which facilitate the setting and placing of the label by their tapered walls. This taper can be provided in an advantageous manner with an angle between 0.5 and 5 degrees.

In a further preferred embodiment of the invention, the positioning member is provided with a ring-shaped base as centering member on the surface of which the centering rod projects in its center. Such a positioning member has the advantage that the ring-shaped base which serves for centering the label is very dimensionally stable, and can form a plain surface, on which a compact disc can be centered by the centering rod projecting in the center. A ring-shaped base serves for the purpose that during transition from the inoperative position to the labeling position, the vertical pressure is transmitted on the positioning member by the user through the supporting beams to the flexible tongues arranged in the outer ring, without any change of the dimensions of the ring-shaped base and the centering rod so that during transition from the inoperative position to the centering position, the position of the label relative to the compact disc remains unchanged.

In a further embodiment of the invention, the centering member can be provided as a ring having a base plate in the center of which the centering rod is arranged. Such a centering ring with a base plate has the advantage that a reliable translation of the pressure force into a tensile force through the supporting beams to the tips of the tongues is achieved during the transition from the inoperative position into the labeling position without a deformation of the centering member.

In a further preferred embodiment of the invention is provided for the centering member to have at least two segments of a circle projecting beyond the top surface of the outer ring and being connected to each other by a circular base plate. This construction corresponds to the construction of a ring-shaped centering member, however, the ring is not realized completely, but rather segments of the ring are provided which are arranged on a circular base plate, whereby the circular base plate in turn receives the tensile forces occurring during the transition from the inoperative position into the labeling position.

In a further embodiment of the invention it is provided for the supporting beams to taper radially inwardly towards the positioning member. By this, the flexibility of the supporting beams is increased in an advantageous manner so that the supporting beams effect only slight resistance during transition from the inoperative position into the labeling position, and effect only slight deformational force on the centering members.

A further embodiment of the invention provides for the flexible tongues to be broader in their tongue root sections than in their tongue tip sections. According to this embodiment, the tongue tips of the flexible tongues in an advantageous manner are stressed stronger than the tongue root sections so that the bottom section of the outer ring is stressed less, and thus, the risk of formation of fissures in the base section of the outer ring is reduced.

In a further embodiment of the invention, the outer ring is enforced at the base section. This can be achieved by a bead-shaped reinforcement. Such a reinforcement serves for the dimensional stability of the outer ring, and reduces the risk of the formation of fissures in the tongue root section of the flexible tongues at the outer ring. In a further preferred embodiment of the invention, the outer ring has an outer flange at its base section. This outer flange can serve for the purpose of fixing the device, e.g., on a mounting table to provide an unchangeable working position. At the same time, the outer flange reinforces the base section of the outer ring so that a risk of the formation of fissures is reduced in the root section of the flexible tongues.

In a further preferred embodiment of the invention, at least three flexible tongues are provided with three flexible supporting beams being arranged on the circumference of the outer ring. Three and more flexible tongues with corresponding flexible supporting beams increase the directional stability of the positioning member during the transition from the inoperative position into the labeling position. At the same time, however, they reduce the support area for the label on the disc-shaped surface of the outer ring.

A further embodiment of the invention provides for a compensation disc to be arranged on the disc-shaped top surface of the outer ring, having a central opening through which the positioning member is freely movable, and supports the label. This compensation disc can be a component which is detachable from the device so that it is replaceable at any time, in case the disc-shaped top surface of the compensation disc is damaged by glue remainders or other remainders of application. This device has the advantage that the working surface on the disc-shaped top surface of the outer ring is renewable at any time by the compensation disc, without the whole device haying to be replaced. Further, the compensation disc can support at least one profile member on its upper surface which is integrally connected to the compensation disc, and is attached integrally to the compensation disc in one-piece.

A process for the use of the device for labeling a compact disc comprises the following procedure steps:

1. fitting the profile member in the mounting position or placing an appropriate compensation disc, in case, a label of an external profile different from a circular shape is to be applied on a corresponding compact disc,
2. placing the label with the non-adhesive side downwards on the horizontal disc-shaped top surface of the base member, whereby the adhesive side of the label points upwards, and the label is pushed with its central opening over the centering member,
3. detaching a lamination sheet from the adhesive side of the label,
4. placing the compact disc with its labeling side downwards onto the positioning member whereby the compact disc is pushed with its central opening over the centering rod, and rests on a centering member, whereby the distance between label and compact disc is determined by the height according to which the centering member projects beyond the disc-shaped top surface in the inoperative position,
5. pushing down the positioning member with the compact disc resting on the centering member from the inoperative position in vertical direction into the labeling position on the adhesive side of the label,
6. relieving the positioning member whereby the positioning member, because of the flexible tongues at the outer ring, bounces back into the inoperative position, and thereby, raises the labeled compact disc resting on the centering member from the top surface of a base member.

This process for labeling a compact disc by using the device according to the invention has the advantage that a reliable centered positioning of the label onto the compact disc is enabled without, on the one hand, damaging the label, and, on the other hand, without the risk of an eccentrical application of the label. Moreover, the risk of tilting the compact disc is reduced because the positioning unit is a compact fixed unit of a centering member and a centering rod, whereby the centering member defines a surface, on which the compact disc remains in plane-parallel alignment with the label during the whole process of labeling, such that tilting of the compact disc is excluded.

A process for manufacturing a labeling device for compact discs preferably has the following process steps:

1. providing a first two-part injection mould having a lower mould and a upper mould forming a hollow mould in an assembled and sealed state, whereby the hollow mould corresponds to the shape of the labeling device,
2. injecting plastic into the closed injection mould under filling up of the hollow mould with plastic,
3. opening the two-part injection mould, and removing the finished labeling device made from plastic,
4. injection molding of the profile member without a compensation disc with profile member by means of a second injection mould.

Due to the construction according to the invention of the labeling device, it is enabled to produce the complete labeling device for circular labels and compact discs in one single injection molding process without any finishing step being required. During injection of the plastic into the injection mould, the injection inlets can be positioned such that they do not interfere with the external shape of the labeling device. To work different external profiles of the label and/or compact disc, only a further injection mould of the shape of a profile member or a compensation disc with profile member is to be produced.

Further features and advantages of the present invention are now explained in detail on the basis of embodiments with reference to the attached drawings.

Figure 1:
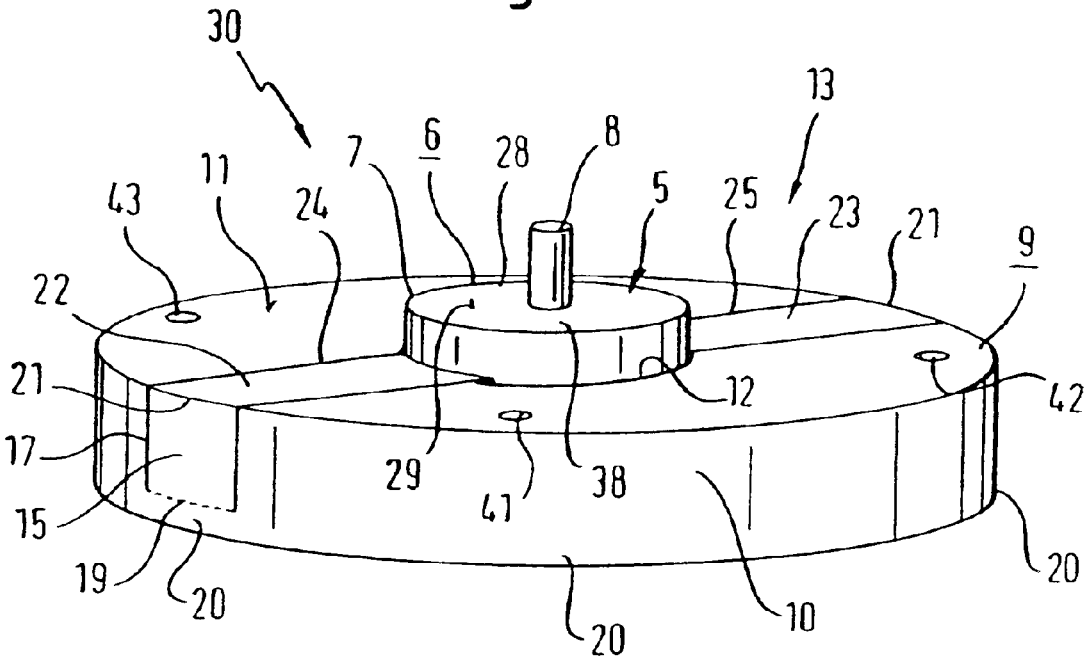
FIG. 1 shows in perspective view a schematic illustration of a first embodiment of the invention in its inoperative position.

FIG. 1 shows in perspective view a schematic illustration of a first embodiment of the invention in its inoperative position. In FIG. 1 reference numeral 5 indicates a positioning member, reference numeral 7 a centering member, and reference numeral 8 a centering member in form of a centering rod, whereby centering member and centering rod form a one-piece unit with the positioning member.

Reference numeral 9 indicates a base member onto which the label can be placed with non-adhesive side downwards whereby the base member has an outer ring 9 with a disc-shaped top surface 10. Two flexible tongues are incorporated into the outer ring from which the flexible tongue 15 can be seen in the perspective illustration of FIG. 1. The flexible tongue 15 has a flexible tongue root 19, and a flexible tongue tip 21. The flexible tongue is made from the material of the outer ring in one-piece, and is arranged in a groove 17 of the outer ring, and can be produced by simple cutting of the outer ring, or during injection molding by dividing the outer ring into outer ring sections and flexible tongue sections. The flexible tongue tips are connected to the positioning member 5 through flexible supporting is beams 22 and 23. Thus, the positioning member 5 is suspended practically at the tongue tips of the flexible tongues through the supporting beams 22 and 23. The disc-shaped top surface of the outer ring, therefore, is subdivided into a fixed part, being able to receive a compact disc, whereby the disc-shaped top surface has a central opening, within which the positioning member is arranged, and grooves 24 and 25, within which the supporting beams are accommodated. In this first embodiment of the invention, the positioning member has a base-shaped centering member 7, whereby the base ends with the flat plate 38, in the center of which the centering rod 8 is arranged. Thus, a compact disc can be placed centrally on the flat plate relative to the ring-shaped base which in turn can align the label.

The reference numerals 41, 42, and 43 indicate circular openings in the top surface 11 of the base member 9 serving as mounting positions 41, 42, and 43 for at least one profile part (not shown). This profile part also enables for aligning labels with any external profile to corresponding compact discs.

For labeling, first, the label is placed on the base member with non-adhesive side downwards, and subsequently the compact disc is set with its labeling top surface downwards centrally over the centering rod 8 on the flat plate 38 on the base surface 29 of the ring-shaped base 28.

Figure 2:
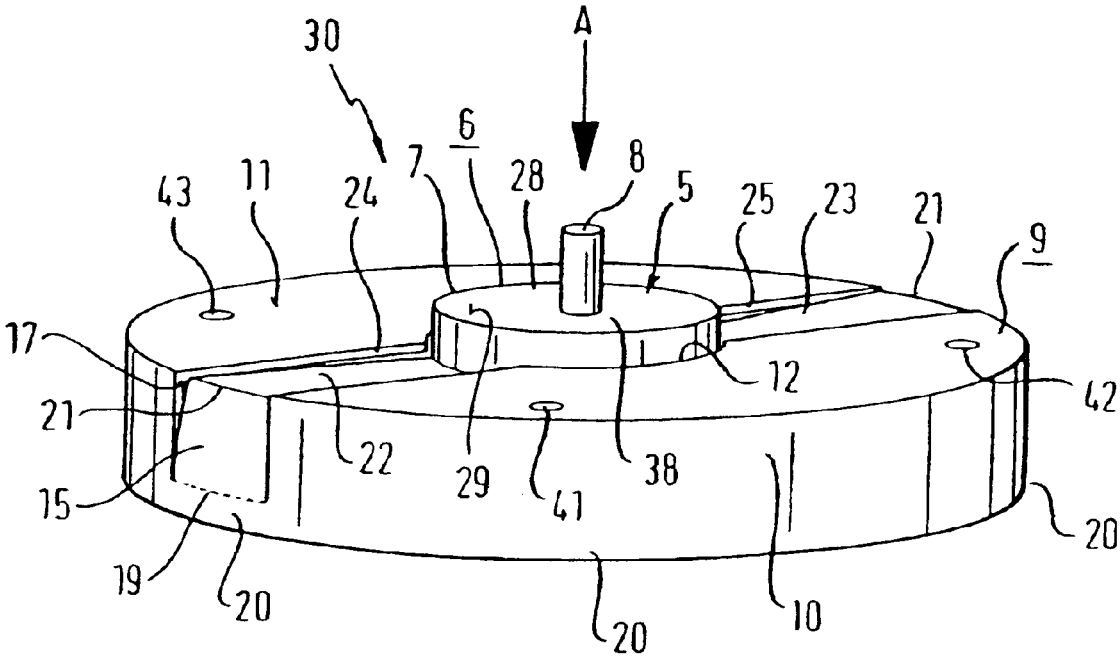
FIG. 2 shows in perspective view a schematic illustration of the first embodiment of the invention in a transitional state from the inoperative position into the labeling position.

FIG. 2 shows in perspective view a schematic illustration of the first embodiment of the invention in a transitional state from the inoperative position into the labeling position. Components fulfilling the same functions as in FIG. 1 are indicated by the same reference numerals, and will not be explained again. For the transition from the inoperative position into the labeling position, positioning member 5 is pushed in arrow direction A into the central opening 12 of the disc-shaped top surface 9 of the outer ring 10. Thereby, the flexible tongue tips 15 and 16 at the outer ring 10 are pushed inwardly, and are biased. Because the flexible tongues themselves have a concave cross-section due to the diameter of the outer ring, a pressure point has to be overcome for the transition from the inoperative position into the labeling position. This pressure point, at the same time, ensures that a lowering of the positioning member 5 in vertical direction cannot result unintendedly during mounting or centering, respectively, of the label and the compact disc. In fact, first, the placing of the label on the disc-shaped top surface 9 of the outer ring 10 is not critical because usually the labels have, on their adhesive side, a lamination sheet. However, already during detachment of the lamination sheet from the label resting on the disc-shaped top surface, the risk of an unintended pushing down of the positioning member exists so that the label will be displaced, flexibly raised, and therefore, will no longer be centered, and will not be resting with a plane surface on the disc-shaped top surface 11 of the outer ring. This risk is prevented by the present device because the flexible tongues 15 arranged at the outer ring 10 have a pressure point due to their concave cross-sections, which requires an intended pushing down in arrow direction A of the positioning member 5 by the user to effect the labeling process. The further advantage of this device with the flexible tongues being concave-curved at the outer ring resides therein that after the labeling has been completed, the positioning member 5 bounces back into a stable inoperative position. The circumference of the massive ring-shaped base 28 and of the centering rod 8 arranged thereon serves for the purpose that no displacement of the compact disc and the centered label placed on top of each other is possible during the transition from the inoperative position to the labeling position. Therefore, the present device facilitates the handling during the labeling of compact discs and ensures that the user can produce a labeled compact disc balance error-free by means of manual labeling.

Figure 3:
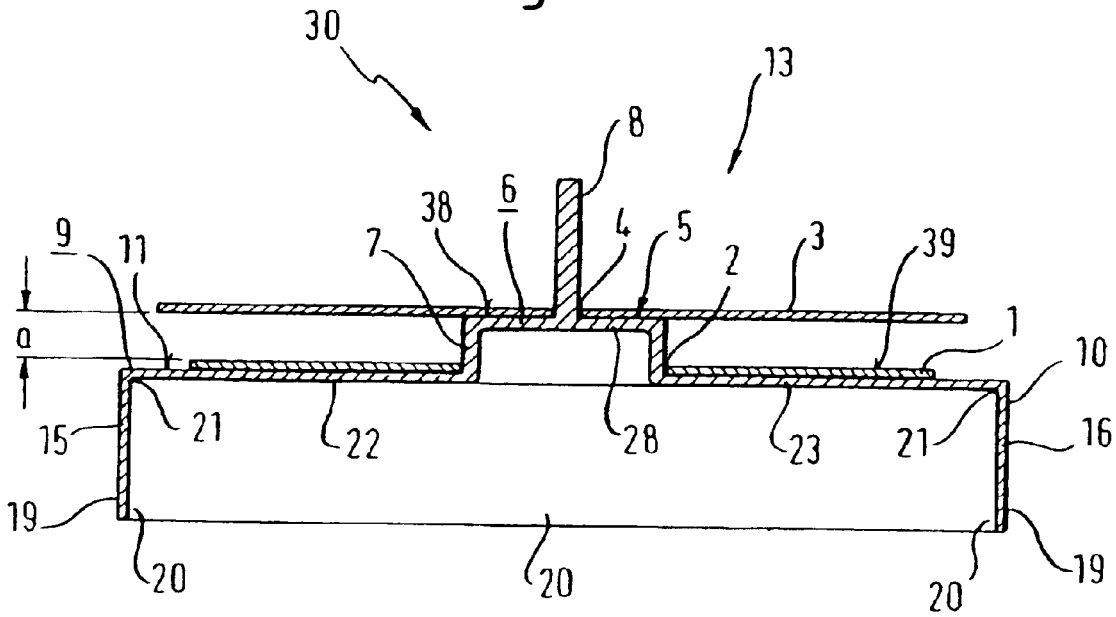
FIG. 3 shows a schematic cross-section of the first embodiment of the invention according to FIG. 1 in an inoperative position.

FIG. 3 shows a schematic cross-section of the first embodiment of the invention according to FIG. 1 in an inoperative position. Components having the same functions as in FIGS. 1 and 2 are indicated by the same reference numerals and are not explained again. Reference numeral 1 indicates a label with a central opening 2 in the label whereby the label is arranged with its adhesive top surface 39 upwards on the disc-shaped top surface 9 of the outer ring 10. Reference numeral 3 indicates a compact disc with the central opening 4 in the compact disc through which the centering rod 8 of the positioning member 5 projects. The centering rod 8 can have a slightly tapered cross-section in longitudinal direction whereby the inclination of the taper is between 0.5 and 5 degrees. Such a taper facilitates the positioning of the compact disc 3 with its central opening 4 on a centering member 7 which, in this first embodiment, is formed base-shaped, and has a flat plate 38 for supporting the compact disc such that the compact disc 3 is supported in a distance a from the adhesive surface 39 of the label 1. The distance a corresponds to the height of the ring-shaped base according to which the latter projects beyond the disc-shaped top surface 11 of the outer ring 10. Due to the characteristics of the pressure point of the flexible tongues 15 and 16, the label 1 as well as the compact disc 3 can be reliably mounted with the aid of the positioning member 5 in the inoperative position of the device.

Figure 4:
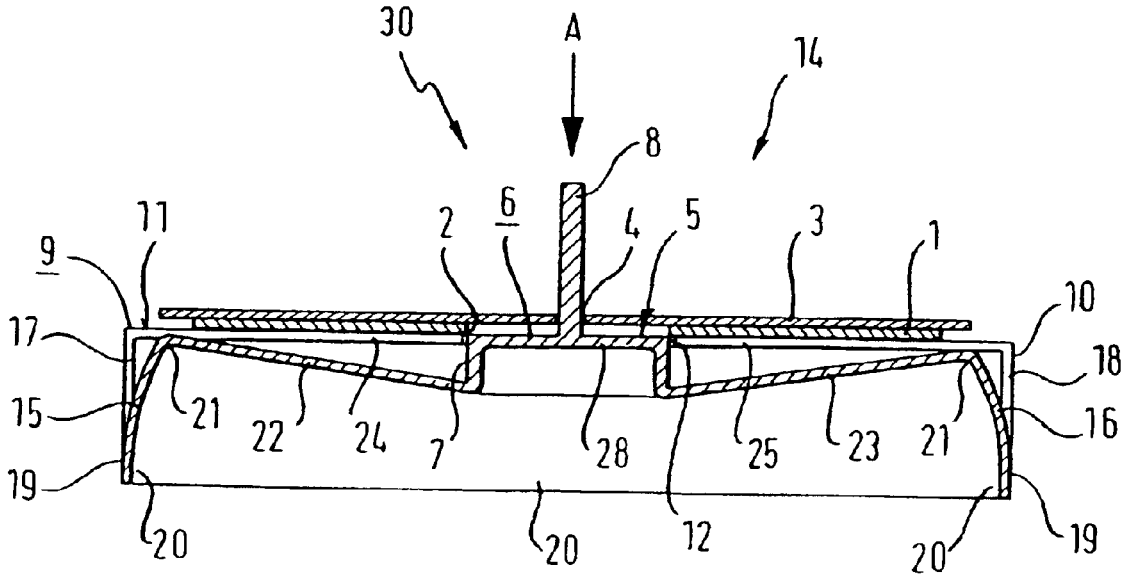
FIG. 4 shows a schematic cross-section of the first embodiment of the invention according to FIG. 1 in its labeling position.

FIG. 4 shows a schematic cross-section of the first embodiment of the invention according to FIG. 1 in labeling position 14. For this, in arrow direction A, a pressure is applied to the positioning member with the compact disc 3 being centrally arranged such that the positioning member, suspended at the supporting beams 22 and 23, is pushed into the central opening 12 of the disk-shaped top surface 11 of the outer ring 10. By this, the pressure point of the flexible tongues 15 and 16 is overcome, and the flexible tongue tips 21 bend radially inwardly towards the positioning member because they are connected through the flexible supporting beams 22 and 23 to the positioning member 5. The geometrical dimensions of the positioning member 5 are maintained during this process such that the outer diameter of the ring-shaped base and the outer diameter of the centering rod 8 do not change. As soon as the pushing of the compact disc 3 onto the label 1 into the labeling position is completed, and the positioning member is relieved, the positioning member being suspended at the supporting beams 22 and 23, bounces by the effect of the flexible tongues 15 and 16 of the outer ring 10. For this, the flexible tongues 15 and 16 are fixedly anchored with their tongue roots 19 in the base section 20 of the outer ring 10. This fixed anchoring can be achieved by the ones-piece manufacturing of the outer ring with flexible tongues.

After the pushing of the compact disc 3 onto the adhesive side 39 of the label 1, the positioning member 5 can be relieved, and bounces back into the inoperative position by means of the elastic effect of the flexible tongues 15 and 16 such that labeled compact disc 3 can be taken off the labeling device without any problems due to the taper of the centering rod.

Figure 5:
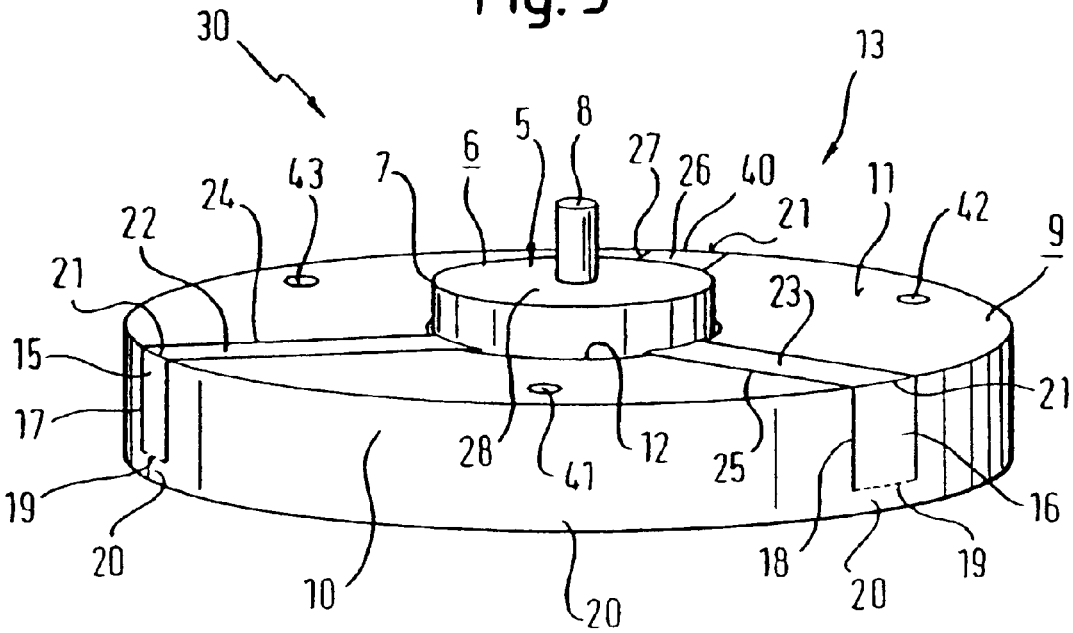
FIG. 5 shows in perspective view a schematic illustration of the second embodiment of the invention in its inoperative position.

FIG. 5 shows in perspective view a schematic illustration of a second embodiment of the invention in its inoperative position. Components in FIG. 5 having the same function as in the preceding Figs. are indicated by the same reference numerals and are not explained further. The second embodiment of the invention shown in FIG. 5, differs from the first embodiment of the invention in that, that instead of two opposing flexible tongues on the outer ring 10, three flexible tongues 15, 16, and 40 are uniformly arranged at the circumference of the outer ring 10. The second embodiment has the advantage that the positioning member 5 is provided as a three-point suspension due to the three supporting beams 22, 23, and 26 and, therefore, the guidance of the positioning member is stable during the transition from the inoperative position 13 into the labeling position.

Figure 6:
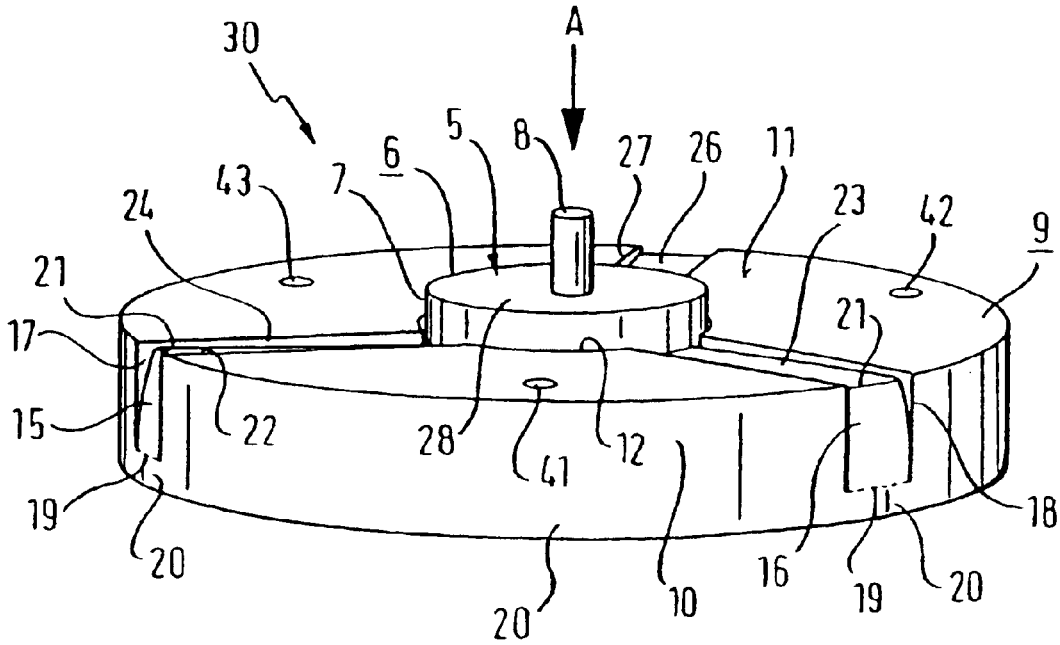
FIG. 6 shows in perspective view a schematic illustration of the second embodiment of the invention in a transitional state from the inoperative position into the labeling position.

FIG. 6 shows in perspective view a schematic illustration of the second embodiment of the invention in a transitional state from the inoperative position into the labeling position. For this, a pressure is applied in arrow direction A onto the positioning member 5 whereby the flexible tongue tips 21 bounce radially inwardly after their pressure point has been overcome. At the same time, the positioning member is lowered with its positioning ring-shaped base 28 into the central opening 12 of the top surface 11 of the base member 9. In case, the positioning member 5 is relieved, it bounces back into its inoperative position.

Figure 7:
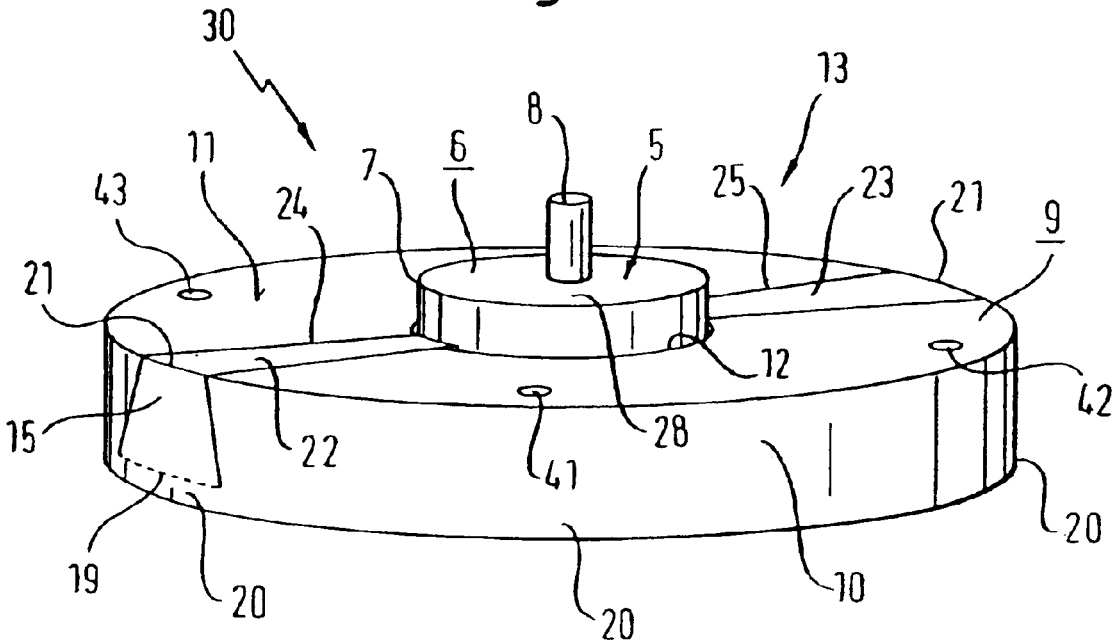
FIG. 7 shows in perspective view a schematic illustration of a third embodiment of the invention in its inoperative position.

FIG. 7 shows in perspective view a schematic illustration of a third embodiment of the invention in its inoperative position. Components of FIG. 7 having the same functions as in FIGS. 1 to 6 are indicated by the same reference numerals, and a renewed explanation is omitted. The third embodiment differs from the first two embodiments of the invention in that the flexible tongues 15 and 16 of the flexible tongue root 19 are broader than at the flexible tongue tip 21. By this, it is achieved that the flexible tongue has a lower restoring force at its flexible tongue tip 21 than at the flexible tongue root 19. Due to this, the flexible tongue becomes softer, however, the pressure point is substantially maintained such that a reliable mounting of the label and compact disc becomes possible in the inoperative position, and the positioning member 5 can, with slight pressure on the centering rod 8, be pushed into the central opening 12 of the top surface 12 of the base member 9.

Moreover, FIG. 7 shows that the supporting beams 22 and 23 are tapered radially inwardly. Due to this taper, the flexibility of the supporting beams 21 and 23 is increased such that the opposing pressure onto the centering element is reduced during the transition from the inoperative position into the labeling position by this measure. Further, the deformational forces onto the centering member 5 by the supporting beams 22 and 23 are reduced due to this taper extending radially inwardly.

Figure 8:
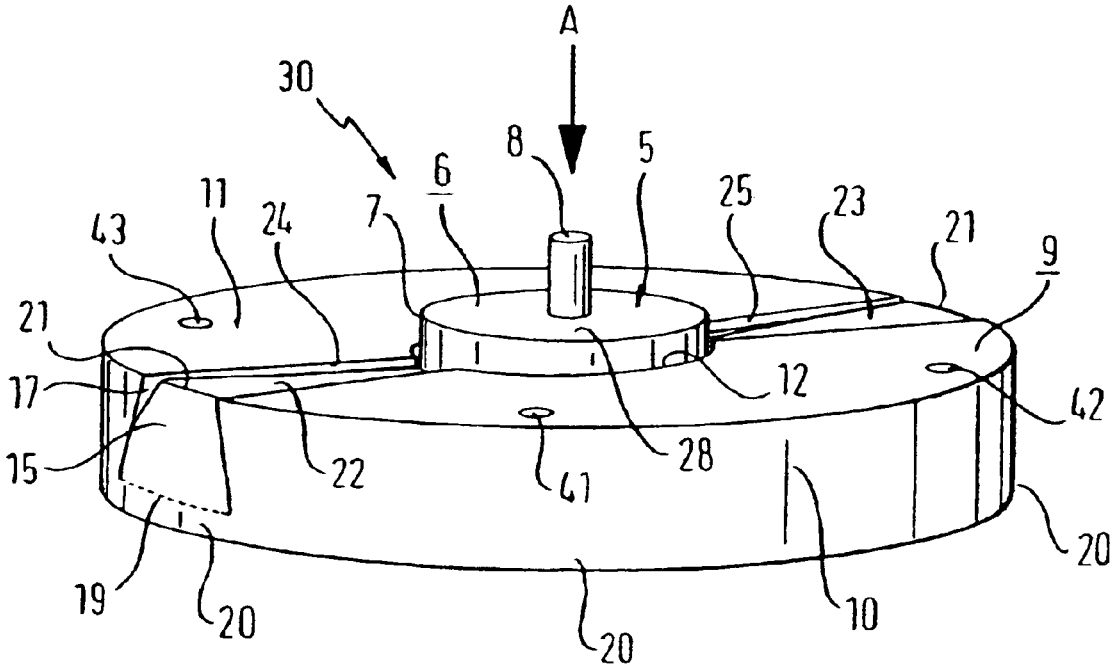
FIG. 8 shows in perspective view a schematical illustration of the third embodiment of the invention in a transitional state from the inoperative position into the labeling position.

FIG. 8 shows in perspective view an illustration of the third embodiment of the invention in a transitional state from the inoperative position into the labeling position. Same components of FIG. 8 as they are shown in FIGS. 1 to 7, are indicated by the same reference numerals and an explanation is omitted.

In FIG. 8, a pushing pressure is applied onto the positioning member in arrow direction A, and by this, the compact disc arranged on the positioning member is pushed downwards. At the same time of pushing down the positioning member 5, the flexible members 15 and 16 at their flexible tongue tips are bent radially inwardly, and the centering member 5 is lowered in a guided manner into opening 12, being fixed to the tapered supporting beams 22 and 23. The restoring force of the flexible tongues on the outer ring 20 is not weakened by the broader construction of the flexible tongue root such that during relieving of the centering member 5, the latter bounces back into its inoperative position.

Figure 9:
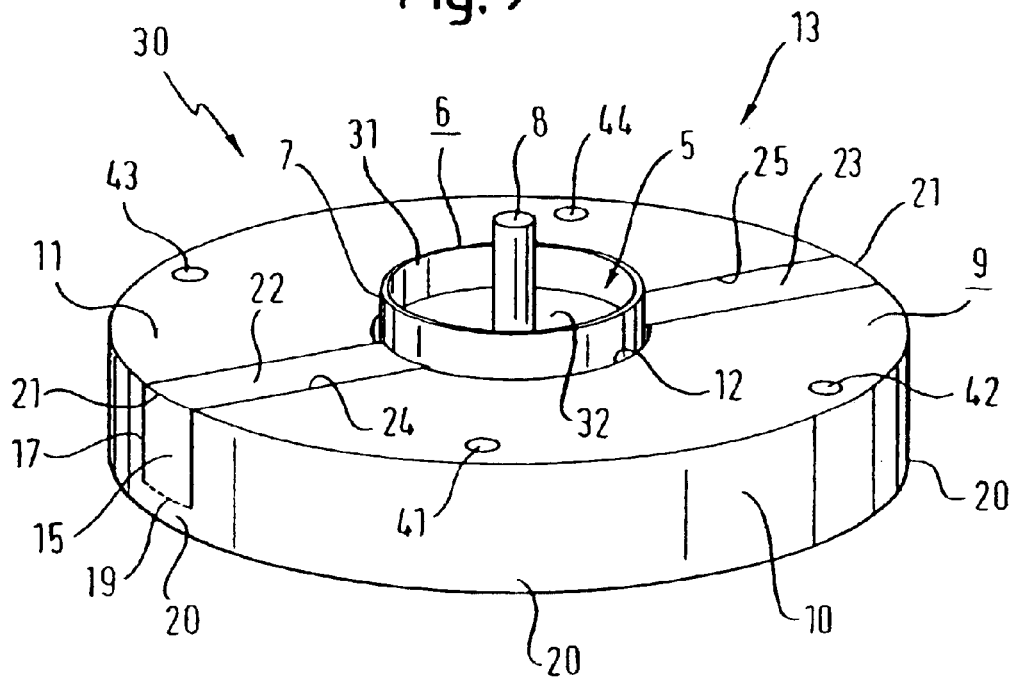
FIG. 9 shows in perspective view a schematic illustration of a fourth embodiment of the invention in its inoperative position.

FIG. 9 shows in perspective view an illustration of a fourth embodiment of the invention in its inoperative position. Components of FIG. 9 having the same functions as in the preceding Figs. are indicated by the same reference numerals. In the following, an explanation of these components is omitted.

The difference of the fourth embodiment of the invention in contrast to the preceding embodiments of the invention essentially resides therein that the positioning member has, instead of a centering base or ring-shaped base, only a centering ring 31. This centering ring is placed on a base plate 32 which is connected with the supporting beams 22 and 23, whereby the positioning member is connected to the flexible tongue tips 71 of the flexible tongues 15 and 16, and is kept in the 0.10 inoperative position 13. For labeling a compact disc, a label is placed with its non-adhesive side downwards on the base member 9, and thereby is centered by the centering ring 31, opposing the centering rod 8 in the center of the positioning member. The compact disc can be placed plane-parallel to the label on the centering ring 31 whereby the ring thickness defines the distance between compact disc and label in the inoperative position 13. During lowering of the centering rod 8 with the positioning member 5, the compact disc is lowered onto the label, and is glued to the label.

Figure 10:
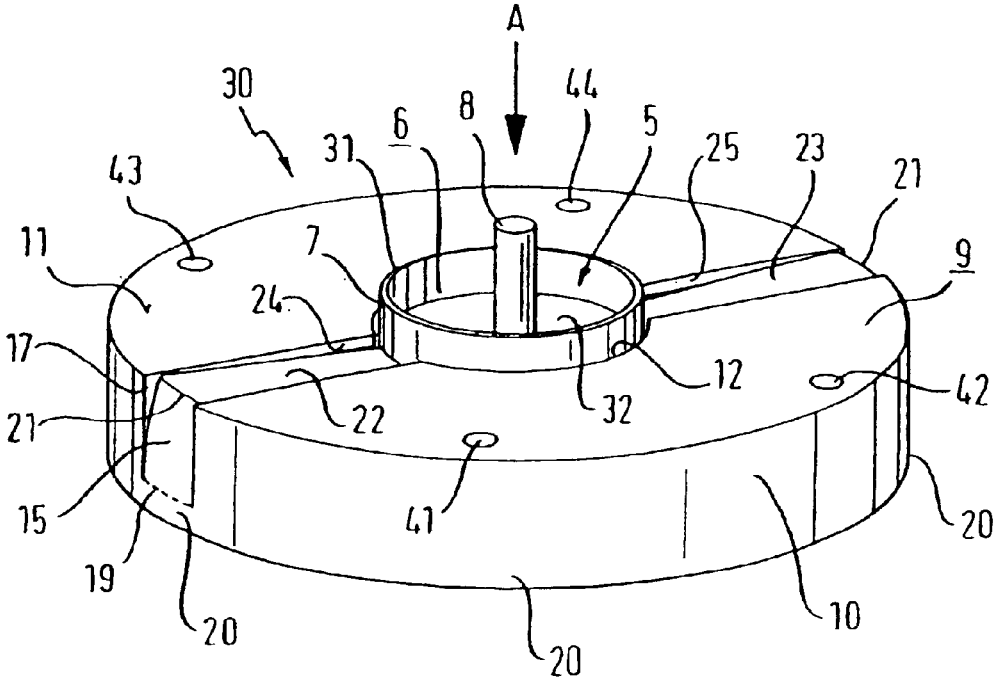
FIG. 10 shows in perspective view a schematic illustration of a fourth embodiment of the invention in a transitional state from the inoperative position into the labeling position.

FIG. 10 shows in perspective view a schematic illustration of the fourth embodiment of the invention in a transitional state from the inoperative position into the labeling position. Because of the positioning member being lowered into the central opening of the base member 9 by means of pushing down in arrow direction A, a placement of the compact disc onto the adhesive side of the label results. Due to the elastic force of the flexible tongues 15 and 16 onto the outer ring 10, the labeled compact disc is raised into the inoperative position after the conglutination of the label on the compact disc, and can be removed from the labeling device.

Figure 11:
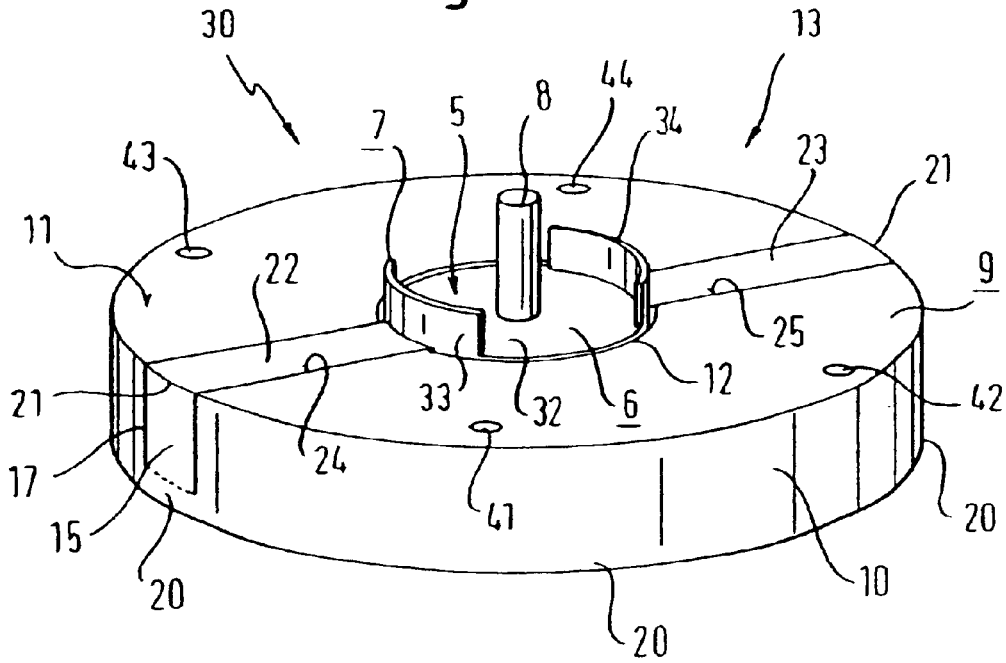
FIG. 11 shows a perspective view of a schematic illustration of a fifth embodiment of the invention in its inoperative position.

FIG. 11 shows a perspective view of a schematic illustration of a fifth embodiment of the invention in its inoperative position. Components of FIG. 11 having the same functions as in the following Figs. are indicated by the same reference numerals, and an explanation of the latter will be omitted. The difference of the fifth embodiment to the preceding embodiments resides therein that the centering ring is not realized completely but rather only centering ring segments are provided in form of ring segments 33 and 34 on the base plate 32 of the positioning member 5. These ring segments are totally sufficient to keep a compact disc in a distance to a label, moreover, the fifth embodiment of the invention according to FIG. 11 has a centering rod 8 in the center of the base plate, centering the compact disc relatively to the label.

Figure 12:
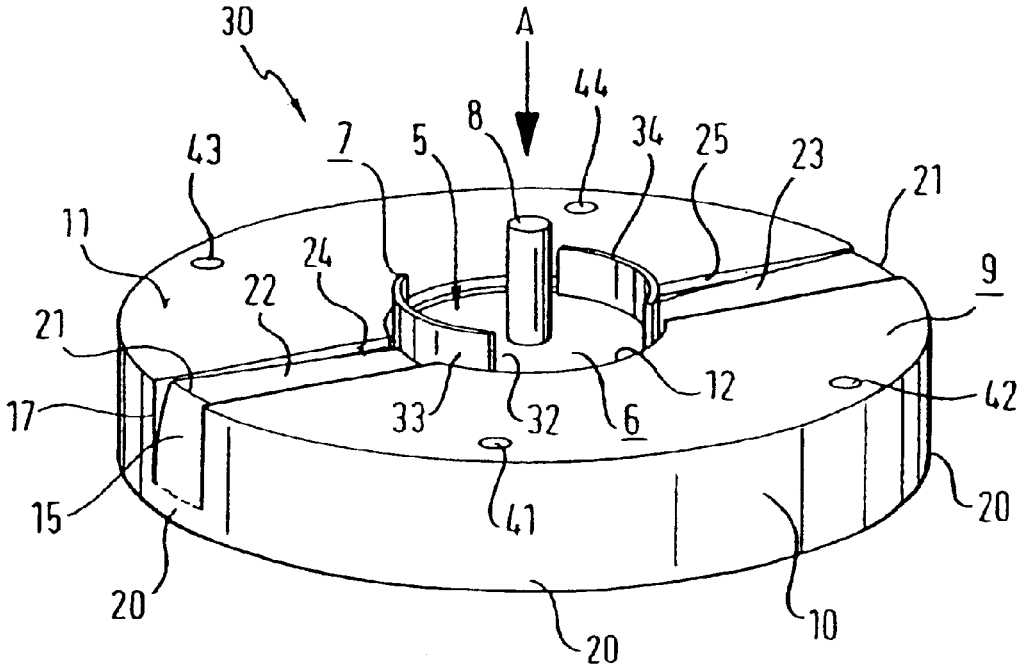
FIG. 12 shows a perspective view of a schematic illustration of the fifth embodiment of the invention in a transitional state from the inoperative position into the labeling position.

FIG. 12 shows a perspective view in schematic illustration of the fifth embodiment of the invention in a transitional state from the inoperative position into the labeling position. Thereby, the positioning member 5 of the labeling device 30 is lowered under the force in arrow direction A into the central opening of the base element 9 such that the compact disc resting on the ring segments is pressed onto the label arranged on the base member. Due to the flexible tongues 15 and 16 at the tongue tips 21 of which supporting beams are suspended supporting the positioning member 5, the positioning member 5 bounces back into the inoperative position as soon as no force is effected in arrow direction A on the positioning member.

Figure 13:
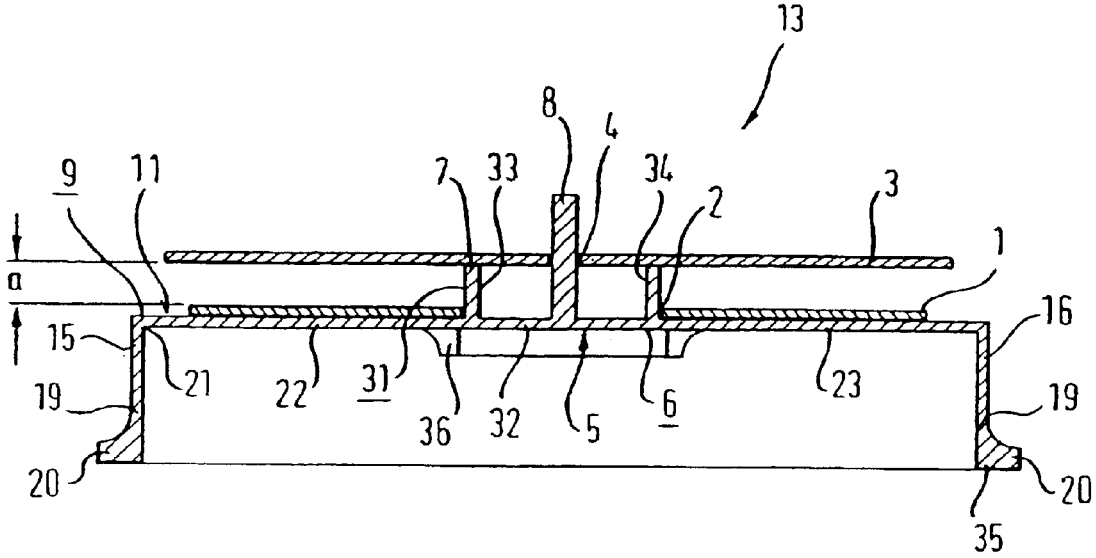
FIG. 13 shows a schematic cross-section of a sixth embodiment of the invention in its inoperative position.

FIG. 13 shows a schematic cross-section through a sixth embodiment of the invention in its inoperative position. Same components in FIG. 13 having the same functions as in the preceding embodiments are indicated by the same reference numerals, and an explanation is omitted. In the cross-sectional view of FIG. 13, the compact disc 3 as well as the label 1 are displayed in their inoperative position, whereby they are in plane-parallel alignment, and keep a distance a, which is determined by the height of the centering ring 31. Instead of a closed centering ring, ring segments 33 and 34 can also be provided, and can generate the same effect, namely that the compact disc 3 is kept with its central opening 4 centrally relative to the label 1 with its central opening 2. The sixth embodiment differs from the embodiments of the preceding Figs. by a reinforced base section 20 at the outer ring 10 and by a reinforcement in the area of the central opening of the disc-shaped top surface 11 of the outer ring 10. This reinforcement of the edge of the central opening 12 serves for the stabilization of the disc-shaped top surface of the base member 9 such that in an advantageous manner, it is ensured that during lowering of the positioning member 5, the compact disc can be placed centrally on the label 1.

Figure 14:
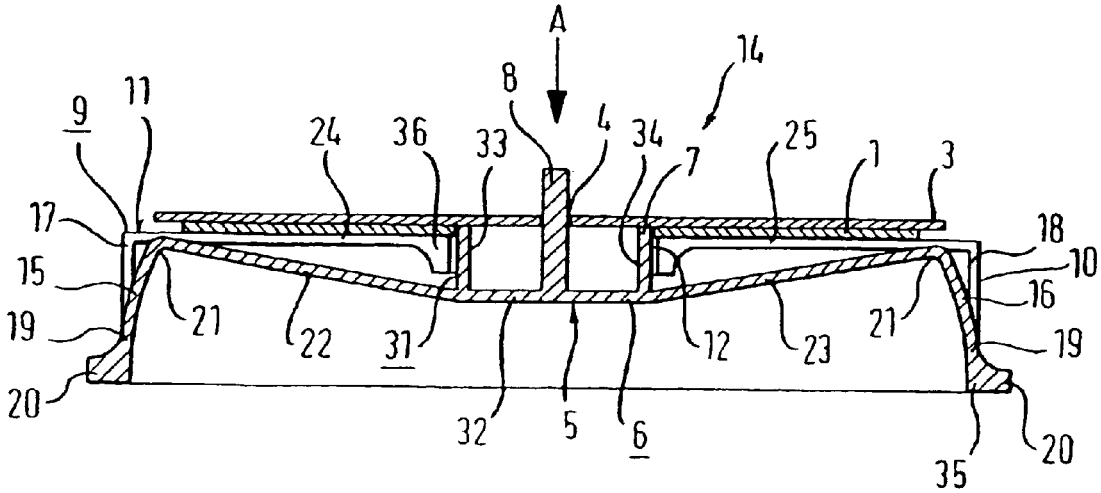
FIG. 14 shows a schematic cross-section of the sixth embodiment of the invention in its labeling position.

FIG. 14 shows a schematic cross-section of the sixth embodiment of the invention in its labeling position. Components of FIG. 14 having the same functions as in the preceding Figs. are indicated by the same reference numerals, and are not explained further. In the sixth embodiment, the shape and planarity of the top surface 11 of the base member 9 is improved by the reinforcement 36, and by the reinforcement 35 of the base section 20, the stability of the device is improved, as well as its resistance against formation of fissures in the area of the flexible tongues 15 and 16 is increased. Besides the reinforcement in radial direction as well as well as in the base section 20 of the outer ring 10 as well as in the area of the central opening 12 of the base member 9, rips can also be provided extending radially from the outer ring towards the central opening 12. A further possibility resides therein that prior to application of the label, a compensation disc is placed on the base member 9, and only then the label is applied. Such a compensation disc has the same central opening as a label, and is centered by the positioning member 5, and serves for the purpose that the grooves 24 and 25 are bridged on the top surface 11 of the basic member 9.

Figure 15:
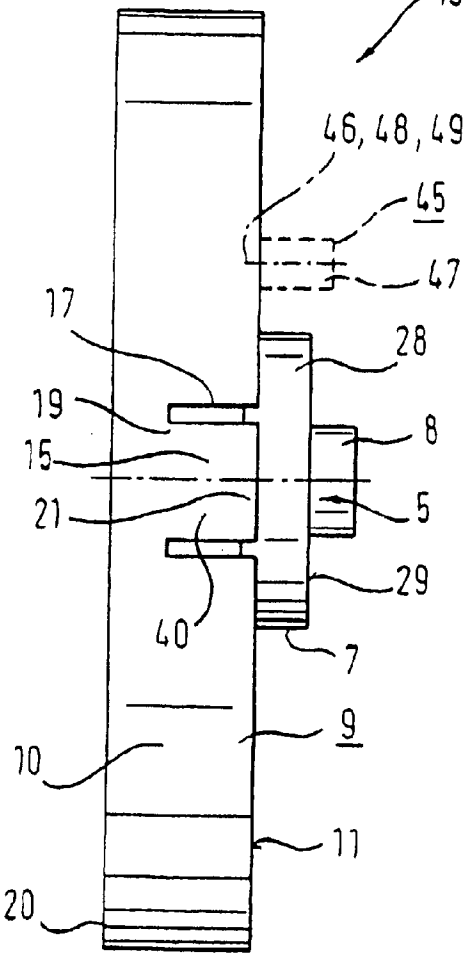
FIG. 15 shows a schematic side view of a seventh embodiment of the invention in its inoperative position.

FIG. 15 shows a schematic side view of a seventh embodiment of the invention in its inoperative position. Components having the same functions as in the preceding Figs. are indicated by the same reference numerals, and are not further explained. In this cross-sectional view, the positioning member is shown in its inoperative position, i.e., it projects beyond the top surface 11 of the base member 10. Further, the outer circumference 10 of the base member 9 with one of the tongues 15 provided with a supporting beam at its tongue tip, keeping the positioning member in an inoperative position. Its tongue root 19 is positioned at the base section 20 of the outer ring 10 whereby the flexible tongue 15 is formed by cutting of the outer ring.

Figure 16:
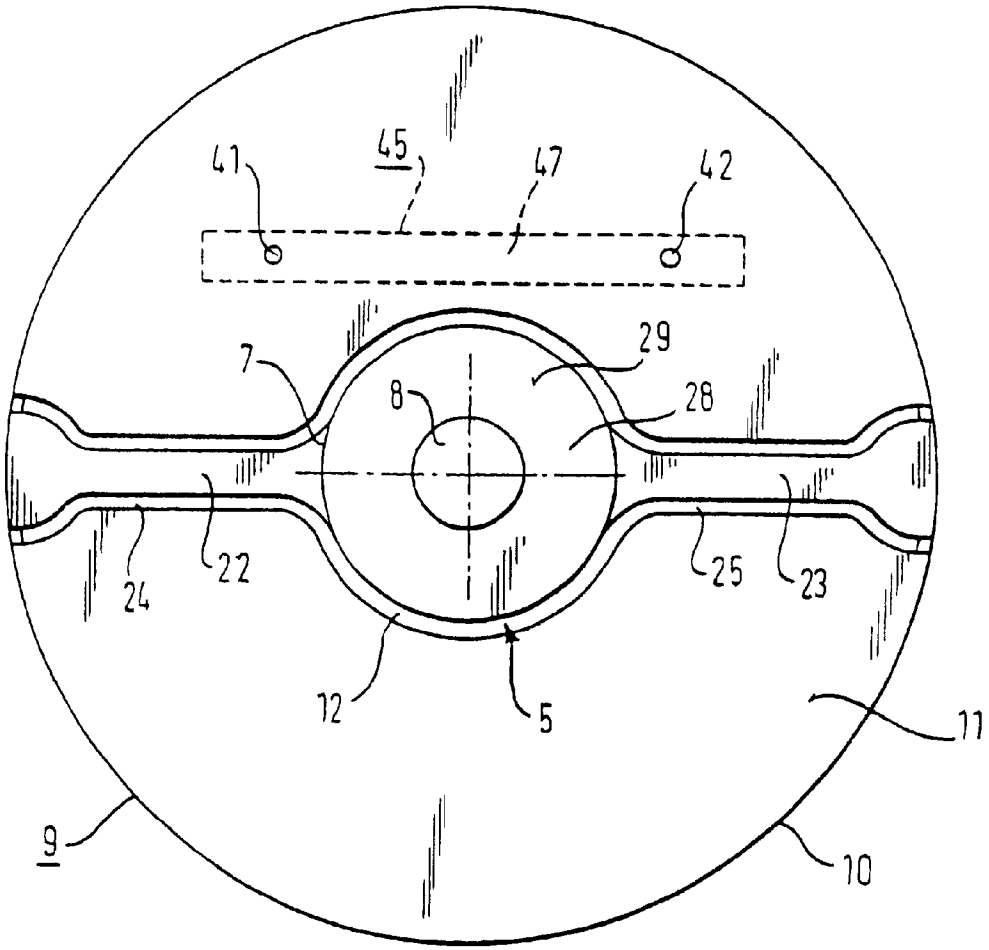
FIG. 16 shows a schematic top view of the seventh embodiment of the invention in its inoperative position.

FIG. 16 shows a schematic top view of the seventh embodiment of the invention in its inoperative position. The top view shows the top surface 11 of the base member 9 with the grooves 24 and 25, within which the supporting beams 22 and 23 are positioned. The supporting beams 22 and 23 are reduced in size with respect to the width of flexible tongue 15, to advantageously improve their flexibility and elastic deformation. The supporting beams 22 and 23 in the grooves 24 and 25 on the top surface 11 of the base member 9 support the positioning member 5 of the labeling device in the central opening 12. Further, the top surface 11 of the base member 9 has two openings, serving as mounting positions 41 and 42. In the se mounting positions 41 and 42, fitted parts of a profile member 45 indicated with the dotted lines, can be inserted. With this pro file part, the top surface 1 of the base member 9 can be fitted to the external profile of a label to align the latter relatively to a corresponding compensation disc.

Figure 17:
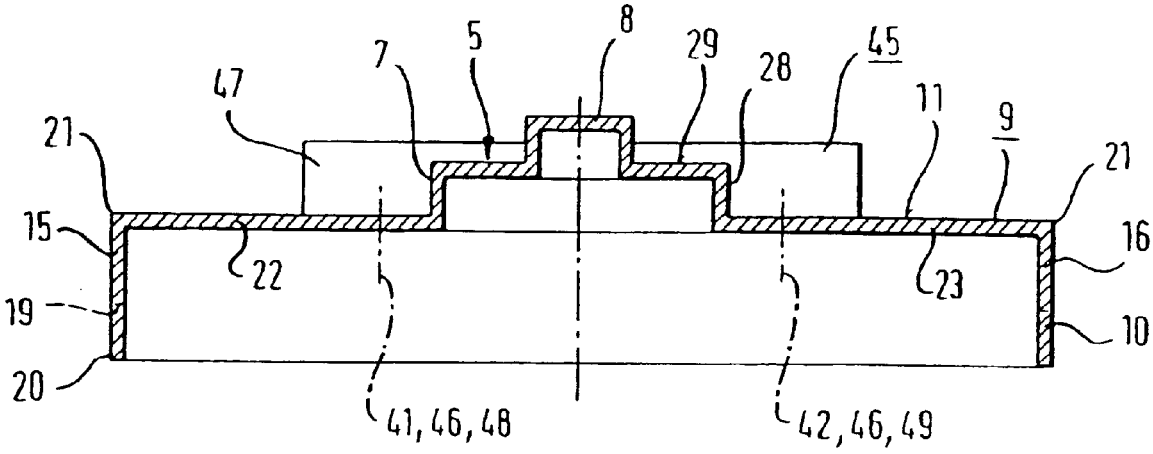
FIG. 17 shows a schematic cross-section view through the seventh embodiment of the invention.

FIG. 17 shows a schematic cross-sectional view through a seventh embodiment of the invention. Components having the same functions as in the preceding Figs. are indicated by the same reference numerals, and are not further explained. In the cross-section of FIG. 17, the base section 20 of the outer ring 10 passes over into the flexible tongues 15 and 16. Supporting beams 22 and 23 are connected at the tongue tips 21 of the flexible tongues 15 and 16, holding the positioning member 5 comprising substantially a centering member 7 for the label and a centering part 8 for the compact disc. The centering member 7 projects beyond the top surface 11 of the base member 9. The centering part 8 is positioned coaxially in the center of the centering member 7, and, in turn, projects beyond the centering member 7.

Further, in this cross-sectional view, a profile part 45 in form a beam 47 can be seen which is positioned in the mounting positions 41 and 42, and forms an abutment wall vertically aligned on the top surface 11 of the base member 9. With the aid of this profile part 45, a straight edge of the external profile of a label can be aligned to ensure that it can be applied onto a corresponding compact disc in a proper alignment.

Figure 18:
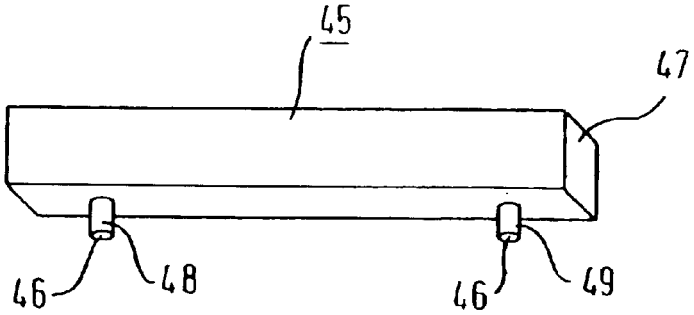
FIG. 18 shows a schematic perspective view of an embodiment of a profile part of the invention.

FIG. 18 shows a schematic perspective view of an embodiment of a profile part 45 of the invention. In this seventh embodiment, the profile part comprises a beam 47 having two journals 48 and 49 at its lower side which can be inserted as fitting parts 46 into the mounting position 41 and 42, shown in FIG. 16. After the insertion of the fitted parts 46 into the mounting positions 41 and 42, the profile part 45 in form of a beam 47 is aligned with respect to the central opening 12 on the top surface 9 of the base member 11 such that the label is aligned with corresponding external profile relative to a corresponding compact disc, and can be applied onto the compact disc. Because of profile parts being fixed on corresponding mounting positions 41 and 42, the application of the device according to the present invention is essentially broadened. For this, the profile part 4S can have any limiting shapes on the top surface 11 of the base member 9 to align the different external profiles of the label with a corresponding compact disc.

These features of the preferred embodiments described above can be combined together.

The term "compact disc", used in the above description includes all disc-shaped data carriers, as e.g. DVD and CD-ROM.

List of Reference Numerals

1 label
2 central opening of the label
3 compact disc
4 central opening of the compact disc
5 positioning member
6 one-piece unit
7 centering member
8 centering part
9 base member
10 outer ring
11 disc-shaped top surface
12 central opening on the top surface
13 inoperative position
14 labeling position
15 and 16 flexible tongues
17 and 18 first grooves in outer ring
19 tongue root
20 base section of the outer ring
21 tongue tips
22 and 23 supporting beams
24 and 25 second grooves in the top surface
26 supporting beams
27 grooves in the top surface
28 ring-shaped base
29 base surface
30 device for labeling
31 centering ring
32 base plate of the centering ring
33 and 34 ring segments
35 outer flange
36 reinforcement
37 circumference of the outer ring
38 flat plate of the base
39 adhesive surface of the label
40 flexible tongue
A arrow direction
41, 42, 43, 44 mounting positions
45 profile part
46 fitted part
47 beams
48, 49 journals

What is claimed:

1. A device for placing a label of any external profile with a first central opening on a compact disc and a second central opening, the device comprising:

a. a positioning member having at least one centering member, the external dimension of which is adapted to the first central opening of the label, and having a centering part in its center, the external diameter of which is adapted to the second central opening of the compact disc, and which projects beyond the centering member;

b. a base member with an outer ring supporting a disc-shaped top surface, on which a label can be arranged, whereby the top surface has a central opening within which the positioning member is located moveably perpendicular to the top surface, and projects beyond the top surface in an inoperative position, and in a labeling position, is lowered into the central opening, where said outer ring has at least one flexible tongue in a first fitted groove of the outer ring, the tongue root of which is connected at a base section of the outer ring and the tongue tip of which supports a flexible supporting beam whereby the supporting beam extends radially inwardly from the tongue tip into a second fitted groove of the top surface up to the positioning member; and c. a second base member having at least one mounting position for at least one profile part at its top surface for adapting the device to the external profile of the label.

2. The device according to claim 1, wherein the profile part has at least one fitted part which is insertable into the mounting position, and the profile part is a beam with at least two journals which are insertable into two fitted mounting positions on the top surface of the base member.

3. The device of claim 1, wherein the mounting position has at least one opening in the top surface of the base member with a polygonal cross-section.

4. The device of claim 1, wherein the profile part has at least one journal with a polygonal cross-section.

5. The device of claim 4, wherein the profile part is positioned on a compensation disc having a central opening corresponding to the central opening of the label.

6. The device of claim 1, wherein the cross-section of the at least one flexible tongue is concave-curved and each of the at least one flexible tongue (15, 16) has a pressure point.

7. The device of claim 1, wherein the positioning member forms a one-piece unit with a centering member and a centering part.

8. The device of claim 7, wherein the centering member and the centering part are moveable together perpendicular to the top surface.

9. The device of claim 1, wherein the centering member, the centering part, the flexible supporting beam, the flexible tongue and the outer ring are connected to each other non-releasably.

10. The device of claim 1, wherein the device is made out of one piece.

11. The device of claim 1, wherein the device is one single injection-molded part.

12. The device of claim 1, wherein the positioning member has a ring-shaped base as a centering member, on the surface of which the centering part projects in the center.

13. The device of claim 1, wherein the centering member is a ring having a base plate in the center of which the centering part is positioned.

14. The device of claim 1, wherein the distance between the compact disc and the label corresponds to the height of the centering member, according to which the centering member projects beyond the top surface of the outer ring.

15. The device of claim 1, wherein the centering member has at least two ring segments projecting beyond the top surface of the outer ring, and are connected to each other through a circular base plate.

16. The device of claim 1 wherein the supporting beams are tapered radially inwardly towards the positioning member.

17. The device of claim 1, wherein the flexible tongue is broader in its tongue root section than in the tongue to tip section.

18. The device of claim 1, wherein the outer ring is reinforced at the base section part.

19. The device of claim 1, wherein the outer ring has an outer flange in the base section.

20. The device of claim 1, wherein the edge region of the central opening of the top surface has a reinforcement provided at the lower side.

21. The device of claim 1, wherein at least three flexible tongues with three flexible supporting beams are positioned on the circumference of the outer ring.

22. A method for using the device of claim 1 for labeling a compact disc comprising the steps of:

a. fitting a profile part into at least one mounting position or placing a corresponding compensation disc having a profile part, in case a label is to be applied on a corresponding compact disc having an external profile differing from a circular shape;

b. placing the label with non-adhesive side downwards onto the horizontal disc-shaped top surface of the base member whereby the adhesive side of the label points upwards, and the label is pushed with its central opening over the centering member;

c. detaching a lamination sheet from the adhesive side of the label;

d. placing the compact disc with its labeling side downwards onto the positioning member whereby the compact disc is pushed with its central opening over the centering part, and rests on the centering member, and whereby the distance between label and compact disc is determined by the height, according to which the centering member projects beyond the disc-shaped top surface in the inoperative position;

e. pushing down the positioning member with the compact disc being placed on the centering member, from the inoperative position in vertical direction into the labeling position onto the adhesive side of the label; and f. relieving the positioning member whereby the positioning member bounces back into the inoperative position due to the flexible tongues at the outer ring, and, thereby raises the labeled compact disc from the top surface of the base member resting on the centering member.

* * * * *